United States Patent [19]

Healey, Jr. et al.

[11] 4,344,808

[45] Aug. 17, 1982

[54] METHOD FOR MANUFACTURING SYNTHETIC RESIN LAMINATE TUBING HAVING A HIGH BURSTING STRENGTH

[76] Inventors: Daniel P. Healey, Jr., 6 Middle Rd., Merrimacport, Mass. 01860; Delbert L. George, 1708 Bayshore Dr., Englewood, Fla. 33533

[21] Appl. No.: 858,811

[22] Filed: Dec. 8, 1977

Related U.S. Application Data

[60] Continuation of Ser. No. 659,334, Feb. 19, 1976, abandoned, which is a division of Ser. No. 579,972, May 22, 1975, Pat. No. 3,979,709.

[51] Int. Cl.[2] ..... B29D 23/10

[52] U.S. Cl. ..... 156/166; 156/194; 156/201; 156/203

[58] Field of Search ..... 156/62.4, 62.6, 201, 156/203, 215, 218, 189, 466, 171, 173, 175, 177, 190, 195, 200, 272, 425, 430, 432, 461, 463; 427/236; 337/159, 161, 290

[56] References Cited

U.S. PATENT DOCUMENTS

| | | | |
|---|---|---|---|
| 3,067,803 | 12/1962 | Fleury | 156/431 |
| 3,287,525 | 11/1966 | Milkulecky | 337/161 |
| 3,340,119 | 9/1967 | Wiltshire et al. | 156/218 |
| 3,531,357 | 9/1970 | Heckly | 156/425 |
| 3,853,656 | 12/1974 | McNeely et al. | 156/172 |
| 3,855,031 | 12/1974 | McNeely et al. | 156/190 |

FOREIGN PATENT DOCUMENTS 1290333 3/1969 Fed. Rep. of Germany .

*Primary Examiner*—David A. Simmons

[57] ABSTRACT

This invention relates to electric fuses having tubular casings having a high bursting strength and to the method and materials by which these casings are made. Such tubular material has also other applications than casings for electric fuses. Tubular structures made in accordance with U.S. Pat. No. 3,979,709 of which this is a division thereof have a plurality of plies which may include strips of non-woven, non-uniformly oriented glass fiber mat, composite strips of woven glass fiber cloth and non-woven glass fiber mat and glass fiber rovings. The plurality of strips are self overlapping and their overlaps are angularly displaced relative to one another. The tubular structure further includes a synthetic thermosetting resin integrating the plurality of strips into a multi-ply laminate.

This invention relates to a process of manufacturing tubular structures of the above referred-to kind by pultrusion. The process includes steps for sequentially arranging the constituent plies of the tubular structure in their required positions, and for integrating the same to a unitary tubular laminate.

1 Claim, 2 Drawing Figures

METHOD FOR MANUFACTURING SYNTHETIC RESIN LAMINATE TUBING HAVING A HIGH BURSTING STRENGTH

This is a continuation of application Ser. No. 659,334 filed 02/19/76 now abandoned which is, in turn, a division of parent application Ser. No. 579,972 filed 05/22/75 which issued on 09/07/76 as U.S. Pat. No. 3,979,709.

BACKGROUND OF THE INVENTION

Tubular materials intended to be used as fuse casings, or fuse tubes, must meet a large number of requirements. They must be able to withstand the high pressures generated inside of fuses when blowing, to withstand without ageing significantly the temperatures prevailing in fuses while the latter are carrying current, be heat-shock resistant, be dimensionally stable, substantially non-tracking, cost-effective, etc. Some of the requirements under consideration can be met easily. There are, however, very few tubular materials which meet most or all requirements.

The basic art of pultrusion is known and has been applied to produce continual lengths of a variety of structures having quite dissimilar geometries, when viewed in cross-section, tubular structures are among these.

The tubular structures manufactured to date however, are not capable of withstanding the conditions to which electric fuses are subjected. In particular a high degree of heat-shock resistance and high bursting strength in excess of a few hundred PSI.

It is therefore the prime object of this invention to provide a method for making tubular structures of glass fiber reinforced synthetic resins that overcome the deficiencies of prior art pultruded tubing and lend themselves for use in electric fuses.

In particular the object of this invention is to provide a method for making tubular structures of glass fiber reinforced synthetic resins that have a high bursting strength and are more cost effective than prior art structures of this description.

Another object of this invention is to provide a novel pultrusion process that is cost effective and yields tubing having a high impact strength or dynamic strength.

Other objects of this invention will be apparent from what follows.

SUMMARY OF THE INVENTION

The process embodying this invention includes the steps of (a) withdrawing from a first supply roll a first composite strip consisting of woven glass fiber cloth having a coextensive liner of non-woven fiber mat material and wrapping said strip around a mandrel in such a way that said woven glass fiber cloth is on the inside and said liner is on the outside, and that said edge regions of said first composite strip overlap in a direction longitudinally of said mandrel;

(b) withdrawing from secondary supply rolls at least one second strip of non-woven glass mat having non-uniformly oriented fibers and wrapping said strip around said first strip in such a way that the longitudinal edges of said second strip overlap in a direction longitudinally of said mandrel;

(c) depositing a plurality of spaced glass fiber rovings in a squirrel cage-like fashion around said mandrel and over said second strip in a direction longitudinally of said mandrel;

(d) withdrawing from tertiary supply rolls at least one third strip of non-woven glass mat having non-uniformly oriented fibers and wrapping said strip around said mandrel and over said rovings in such a way that the longitudinal edges of said third strip overlap in a direction longitudinally of said mandrel;

(e) withdrawing from a fourth supply roll a second composite strip consisting of woven glass fiber cloth having a coextensive liner of non-woven fiber mat material and wrapping said strip around said mandrel and over said third strip in such a way that said woven glass fiber cloth is on the outside and said liner is on the inside and that the edge regions of said second composite strip overlap in a direction longitudinally of said mandrel;

(f) jointly expanding said first strip, said second strip, said rovings, said third strip, and said fourth strip on said mandrel by transferring the same from a region of relatively small diameter to a region of relatively large diameter; and (g) establishing a flow of liquid thermosetting synthetic resin inside said mandrel in a direction longitudinally thereof and allowing said thermosetting resin to escape from said mandrel in a direction substantially transversely of said mandrel at a point thereof where said first strip, said second strip, said rovings, said third strip, and said fourth strip have been jointly expanded whereupon the same are then jointly impregnated with synthetic resin.

DESCRIPTION OF PREFERRED EMBODIMENTS

A tubular structure manufactured according to this invention includes a more or less central, squirrel cage arrangement of longitudinally oriented glass fiber rovings which are intimately sandwiched between strips of non-woven, non-uniformly oriented glass fiber mat material which in turn, may again jointly or singly be sandwiched between more strips of non-woven non-uniformly oriented glass fiber mat material. Ultimately, the last strips of glass fiber mat material are themselves sandwiched by composite strips consisting of woven glass fiber cloth superimposed with a layer of non-woven glass fiber mat in such a way that the woven glass fiber cloth is both on the outside and on the inside of the completed tubular structure. The structure further includes a thermosetting resin integrating said strips into a tubular multi-ply laminate.

Figure 1:
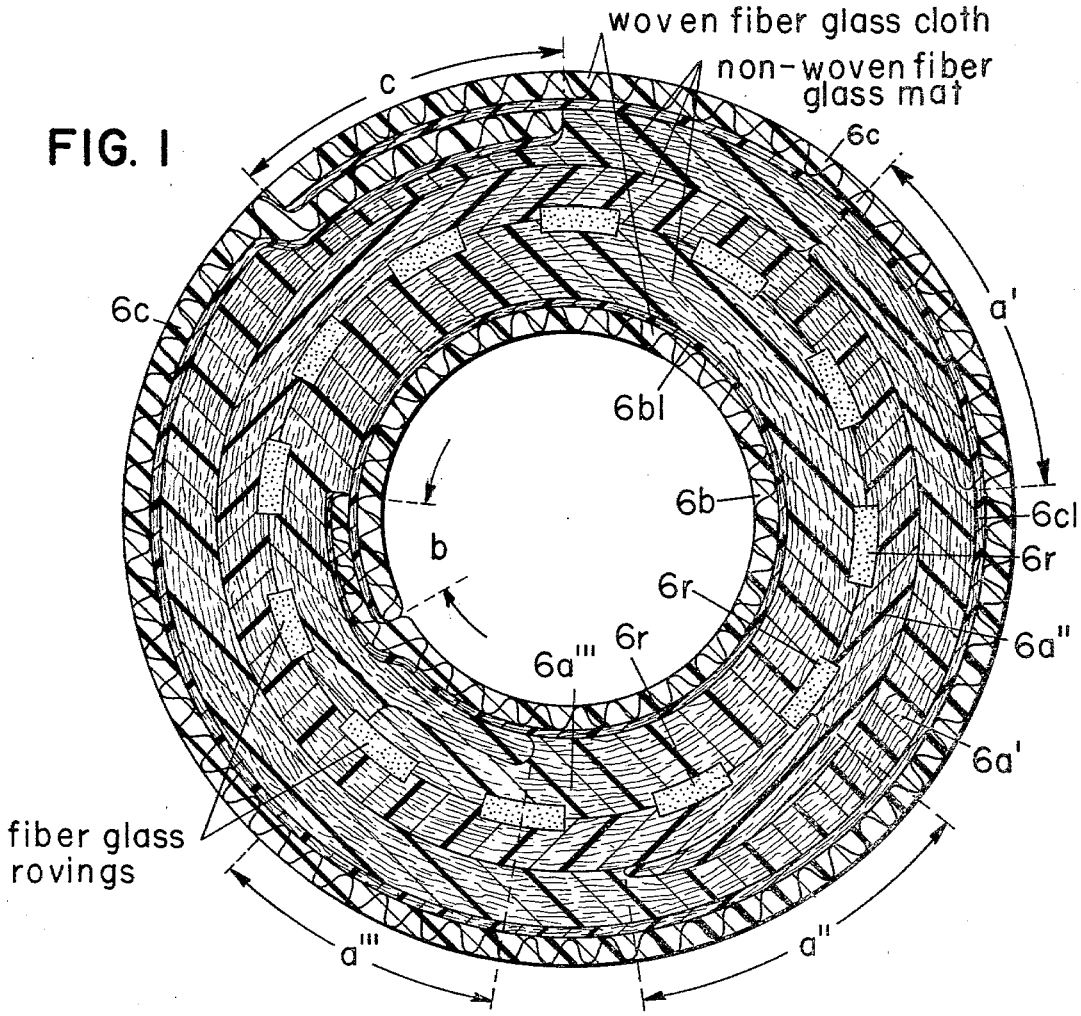
FIG. 1 is a diagrammatic cross-section of a tubular structure manufactured according to this invention.

Referring now to the drawings FIG. 1 shows diagrammatically a cross-section of a tubular structure for use as a fuse casing and manufactured according to this invention. Reference characters 6c and 6b have been applied to indicate the outermost strip and the innermost strip, respectively, of the fuse casing. Strips 6c and 6b are of woven glass fiber cloth and carry coextensive liners 6c1 and 6b1 of non-woven glass fiber mat on the inside and outside thereof. Strips 6c, 6c1 and 6b, 6b1 are therefore substantially coextensive composite strips of woven glass fiber cloth and non-woven glass fiber mat. As shown in FIG. 1, the tube includes one or more strips i.e. *6a'*, *6a''*, *6a'''* of non-woven glass fiber material arranged between strips *6c*, *6c1* and *6b*, *6b1*.

In addition the tube in FIG. 1 includes a plurality of spaced glass fiber rovings *6r* deposited in squirrel cage fashion between two non-woven mat strips *6a''*, *6a'''* and extending in a direction longitudinally of the tubing.

The tubular structure of FIG. 1 is further defined as follows. A first composite strip *6b*, *6b1* is wrapped around a mandrel in such a way that the strip *6b* of woven glass fiber cloth is on the inside, in contact with the mandrel, and liner layer *6b1* of non-woven glass fiber mat is on the outside. The composite strip *6b*, *6b1* has a circumferential extent greater than 360°, therefore the edge regions are overlapped at b, in a direction longitudinally of said mandrel. Liner layer *6b1* therefore overlaps at an area which is substantially coextensive with the area of overlap b of strip *6b*.

At least one second strip *6a'''* of non-woven glass fiber mat is wrapped around said mandrel and over said composite strip *6b*, *6b1*. Said second strip has a circumferential extent in excess of 360° and the longitudinal edges thereof overlap at a''' in a direction longitudinally of said mandrel.

A plurality of glass fiber rovings *6r* are now longitudinally deposited in squirrel cage fashion around said mandrel and over said second strip *6a'''*.

At least one third strip of non-woven glass fiber mat is then wrapped around said mandrel and over said rovings *6r*. FIG. 1 shows two such strips *6a''* and *6a'* each having circumferential extents greater than 360° and overlapping in a direction longitudinally of said mandrel at a'' and a' respectively.

A second composite strip *6c*, *6c1* is the final layer comprising the tubular structure. Composite strip *6c*, *6c1* is wrapped around the mandrel and over said third strip, in such a way that the strip *6c* of woven glass fiber cloth is on the outside and liner layer *6c1* is on the inside in contact with the previously applied strip *6a'*. The composite strip *6c*, *6c1* also has a circumferential extent greater than 360° and the longitudinal edges are overlapped at c in a direction longitudinally of said mandrel. Liner layer *6c1* therefore overlaps at an area which is substantially coextensive with the area of overlap c of strip *6c*.

It is desirable to provide both strips *6b* and *6c* with coextensive non-woven glass fiber liners or linings *6b1* and *6c1*. As an alternative, but one of the two strips *6b*, *6c* may be provided with a coextensive non-woven glass fiber lining.

As a general rule, it is of great importance to have said regions of overlap b, a''', a'', a' and c angularly displaced with respect to one another. In other words, the overlap of any one strip is not in the same circumferential region of the tubular structure occupied by the overlap of another strip, but the overlaps are more or less evenly distributed around the circumference. This contributes in large part to the high bursting strength achieved by the tubular structure and also aids in maintaining the uniformity of wall thickness as follows:

The areas of overlaps b, a''', a'', a' and c create regions of increased thickness within the tubular structure wrapped on the mandrel. The strips of glass fiber mat in the tubular structure have relatively low fiber densities, as compared to the strips of woven glass fiber cloth, and therefore exhibit a high degree of compressibility. When the tubular structure is pulled through a pultrusion die, these strips of non-woven glass fiber mat compensate for the regions of increased thickness due to said overlaps by compressing to a larger extent in said regions thereby allowing for a tubular structure of uniform wall thickness. In other words, when an insert having points of different thickness is pulled through a pultrusion die, a tube of uniform wall thickness results.

Any synthetic thermosetting resin that lends intself to processing in a pultrusion machine lends itself to manufacturing multiply tubing and fuse casings of the above description. If it is intended to cure the tubing by high frequency electrical oscillations the resin must include polar molecules caused under the action of an electric field to move at high velocities. These molecules collide with adjacent molecules—whether polar or not polar—and impart some of their kinetic energy to the latter. The process of high frequency curing of pultruded parts is well known in the art, and does not call for specific description in this context.

A hardner and other ingredients must be admixed to the thermosetting resin. The formulation of the mixture depends upon the application of the tubing. Tubing intended to be used as casing material for electric fuses calls for thermosetting resins which include inorganic fillers, anti-tracking fillers and flame-retardent or resistant media. Such substances are well known in the art and reference may be had, in this connection, for instance to U.S. Pat. No. 3,287,525 to H. W. Mikulecki, 11/22/66 describing such substances. Thermosetting resins which are particularly flame-resistant are also often referred-to as self-extinguishing resins and are well known in the art.

Pultrusion machinery is also well known in the art and reference may be had to the following patents in regard to a detailed disclosure of pultrusion machinery. U.S. Pat. No. 2,871,911 to W. B. Goldworthy et al, 02/02/59 for APPARATUS FOR PRODUCING ELONGATED ARTICLES FROM FIBER-REINFORCED PLASTIC MATERIAL and U.S. Pat. No. 3,556,888 to W. B. Goldworthy, 01/19/71 for PULTRUSION MACHINE AND METHOD.

Figure 2:
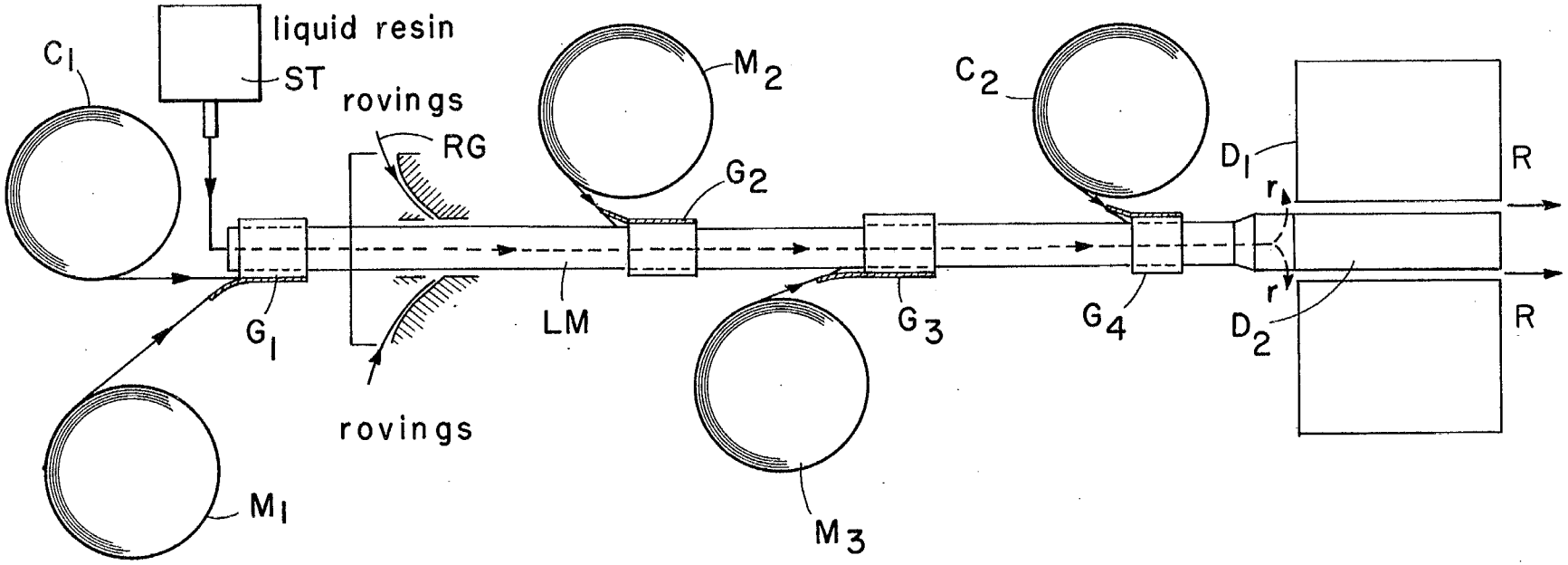
FIG. 2 is a diagrammatic representation of the pultrusion process for making tubular structures according to this invention.

FIG. 2 shows diagrammatically a pultrusion machine as disclosed in U.S. Pat. No. 3,556,888 adapted to produce high-strength tubing material.

Reference character $C_1$ has been applied to indicate a first supply roll of woven glass fiber cloth having a coextensive liner of non-woven glass fiber mat and reference character $M_1$ has been applied to indicate a supply roll of glass fiber mat having substantially random oriented fibers. The strips of composite woven glass fiber cloth and non-woven glass fiber mat derived from roll $C_1$ is directly folded upon a long mandrel LM so that the woven glass fiber cloth rests on the mandrel and said coextensive liner is on the outside thereof and the strip of non-woven mat derived from roll $M_1$ is folded on mandrel LM upon the liner layer of said composite derived from roll $C_1$. The guiding and folding of the materials derived from rolls $C_1$ and $M_1$ is effected by means of the guiding and folding device $G_1$. Glass fiber rovings derived from a source of such material (not shown) are deposited on mandrel LM over the layers derived from rolls $C_1$ and $M_1$ in such a way as to form a squirrel-cage-like structure of peripherally spaced rovings surrounding mandrel LM and engaging the strip of non-woven glass mat derived from drum $M_1$. This deposition of rovings is effected by means of a roving guide structure RG having an axially inner surface substantially in the shape of a truncated cone. Reference characters $M_2$ and $M_3$ have been applied to indicate a pair of supply rolls of glass fiber mat having substantially random oriented fibers. A strip of such material derived from roll $M_2$ is supplied to guiding and folding device $G_2$ and folded around the layer of rovings on mandrel LM. Another strip of glass fiber mat material derived from roll $M_3$ is supplied to guiding and folding device $G_3$ and folded over the layer derived from roll $M_2$. The number of non-woven glass fiber mat supply rolls may be increased or decreased in accordance with this invention depending upon the particular size and performance parameters required of any particular tubular structure. Reference character $C_2$ has been applied to indicate a second supply roll of woven glass fiber cloth having a coextensive liner of non-woven glass fiber mat for forming the outermost ply of the multiply tubing material. This composite strip woven glass fiber cloth and non-woven glass fiber mat derived from supply roll $C_2$ enters a guiding and folding device $G_4$ and is folded around the radially outer layers of glass fiber material supported by mandrel LM, so that the liner of non-woven glass fiber mat contacts said outer layers and the woven glass fiber cloth forms the outermost layer of the tubular structure. The mandrel LM has a predetermined diameter which is relatively small, except on its right end where the diameter of mandrel LM is increased. As a result, the several layers of woven glass fiber cloth and non-woven glass fiber mat rest relatively loosely on mandrel LM except on the right enlarged end of the latter, where the constituent reinforcement plies of the tubing are expanded radially outwardly. The mandrel LM is hollow, or has a central bore. Synthetic resin under pressure is admitted from supply tank ST to the left end of mandrel LM and flows through the latter to the right end thereof. The several plies of glass fiber material on mandrel LM are not wetted by the synthetic resin before these plies have been radially expanded by the right end of mandrel LM of increased diameter. Curing of the impregnating resin is effected in a heated die including the outer tunnel forming portion $D_1$ and the inner mandrel shaped portion $D_2$ defining a toroidal annular gap therebetween. The finished product is pulled through that gap in the direction of the arrows R by conventional pulling machinery as used in pultrusion machines.

The impregnation with resin of the multiply fibrous reinforcement insert formed on mandrel LM occurs at a point situated at the right end of mandrel LM indicated by arrows r. At this point the synthetic resin is allowed to flow radially outwardly from the inside of mandrel LM transversely through the multiple plies on mandrel LM. The excess of synthetic resin not used for impregnating the constituent reinforcement plies of the casing is drained off by appropriate draining means not shown in FIG. 2. Impregnation of the reinforcement plies of the tubing is effected at a point following radial expansion of these plies and before the latter are allowed to enter into the toroidal gap formed between parts $D_1$ and $D_2$.

The present tubular structure has been developed to meet the specific requirements of fuse casings and to coact with other parts of fuses incident to interruption of short-circuit currents so as to withstand high shock loading with maximal cost-effectiveness. The tubular structure resulting from this manufacturing method has not only a high dynamic strength in regard to pressures generated by exploding fusible elements, but has also a considerable hoop strength, or bursting strength, within the meaning of ASTM Standard D 1180–57 (1961) "Bursting Strength of Round Rigid Plastic Tubing". Hence the use of the tubular structures which have been outlined above is not limited to casings of fuses. These structures are applicable wherever plastic tubing is needed whose strength to withstand almost instantaneous loading by internal pressures is high, and wherever plastic tubing is needed whose bursting strength within the meaning of the above ASTM Standard is high.

I claim as my invention:

1. A method of manufacturing electric fuse casings by the pultrusion process including the steps of (a) wrapping a first composite strip consisting of woven glass fiber cloth having a coextensive liner of non-woven fiber mat material around a mandrel in such a way that said woven glass fiber cloth is on the inside and said liner on the outside, and that the edge regions of said first strip overlap in a direction longitudinally of said mandrel;

(b) wrapping at least one second strip of non-woven glass mat having non-uniformly oriented fibers around said first strip in such a way that the longitudinal edges of said second strip overlap in a direction longitudinally of said mandrel;

(c) depositing a plurality of spaced glass fiber rovings in squirrel cage-like fashion around said mandrel and over said second strip in a direction longitudinally of said mandrel;

(d) wrapping at least one third strip of non-woven glass-mat having non-uniformly oriented fibers around said mandrel and over said rovings in such a way that the longitudinal edges of said third strip overlap in a direction longitudinally of said mandrel;

(e) wrapping a fourth strip consisting of woven glass fiber cloth having a coextensive liner of non-woven fiber mat material around said mandrel in such a way that said woven glass fiber cloth is on the outside and said liner is on the inside and that said edge regions of said fourth strip overlap in a direction longitudinally of said mandrel;

(f) jointly expanding said first strip, said second strip, said rovings, said third strip, and said fourth strip on said mandrel by transferring the same from a region of relatively small diameter to a region of relatively large diameter; and (g) establishing a flow of liquid thermosetting synthetic resin inside said mandrel in a direction longitudinally thereof and allowing said thermosetting synthetic resin to escape from said mandrel in a direction substantially transversely of said mandrel at a point thereof where said first strip, said second strip, said rovings, said third strip, and said fourth strip have been jointly expanded whereupon the same are then jointly impregnated with synthetic resin.

* * * * *